US005928973A

United States Patent [19]

Daniel et al.

[11] Patent Number: 5,928,973

[45] Date of Patent: Jul. 27, 1999

[54] NONWOVEN NEEDLEPUNCH FABRIC AND ARTICLES PRODUCED THEREFROM

[75] Inventors: Mason B. Daniel; Erman L. Creekmore, both of Columbus, Miss.; Jeffery A. Hedrick, Sulligent, Ala.

[73] Assignee: American Nonwovens Corporation, Columbus, Miss.

[21] Appl. No.: 08/937,594

[22] Filed: Sep. 29, 1997

[51] Int. Cl.[6] ..... D04H 1/46; D04H 3/10

[52] U.S. Cl. ..... 442/407; 442/403; 442/402; 442/334

[58] Field of Search ..... 442/334, 402, 442/403, 405, 407, 415, 416

[56] References Cited

U.S. PATENT DOCUMENTS

| | | | |
|---|---|---|---|
| 4,239,792 | 12/1980 | Ludwa | 428/198 |
| 4,246,221 | 1/1981 | McCorsley | 264/203 |
| 5,094,690 | 3/1992 | Zikeli et al. | 106/198 |
| 5,311,389 | 5/1994 | Howey | 360/133 |
| 5,421,898 | 6/1995 | Cavanagh | 134/7 |
| 5,475,903 | 12/1995 | Collins | 28/104 |
| 5,623,888 | 4/1997 | Zafiroglu | 112/414 |
| 5,733,750 | 3/1998 | Lund et al. | 435/72 |
| 5,733,826 | 3/1998 | Groitzsch | 442/364 |

*Primary Examiner*—Marion McCamish
*Assistant Examiner*—Cheryl Juska
*Attorney, Agent, or Firm*—Smith, Gambrell & Russell, LLP; Beveridge, DeGrandi, Weilacher & Young

[57] ABSTRACT

A non-woven fabric formed from a blend of lyocell fibers and polyester fibers has good loftiness and softness, low lint level, improved wet strength, good working properties as well as fluid retention properties.

5 Claims, 1 Drawing Sheet

NONWOVEN NEEDLEPUNCH FABRIC AND ARTICLES PRODUCED THEREFROM

INTRODUCTION AND BACKGROUND

The present invention relates to needlepunch nonwoven fabrics based on a blend of lyocell fibers and polyester fibers.

Over the years there have been many developments relating to the production of fibers and fabrics derived from cellulose and more particularly shaped cellulose articles such as fibers, yarns and fabrics. Industry has long sought to produce fabrics having properties which approach those of cotton fabrics because the latter are known for enjoying wide acceptance and preference among consumers.

The conventional process for making such materials as rayon is the viscose process which involves dissolving cellulose or a derivative of cellulose in a solvent, shaping the resulting solution and recovering the cellulose from the solution as a solid shaped article such as a fiber. The art has known about rayon for many years but there exist a number of significant disadvantages with rayon including its mechanical properties, poor wet collapse properties and a large increase in wet elongation even under low stress. More specifically, the wet modulus of conventional viscose reduces its applicability for many important functions where dimensional stability is needed.

Many efforts have been made to develop processes for making improved regenerated cellulose fibers having superior properties than the older rayon products with some success. For example, cellulose fibers have been made from a solution of cellulose in a tertiary amine N-oxide solution. This is disclosed, for example, by Graenacher et al., U.S. Pat. No. 2,179,181. However, there have been problems observed with the Graenacher system because of the low solids content which requires the handling of large volumes of solvents. Later developments include a system of dissolving cellulose in an anhydrous tertiary amine N-oxide; see Johnson, U.S. Pat. No. 3,447,939. Here again, however, large amounts of solvents are required to be handled.

Subsequent technology included the addition of different polymers dissolved in a solvent based on the tertiary amine N-oxide system; See Johnson, U.S. Pat. No. 3,508,941.

Further efforts have been devoted to producing cellulosic articles having properties more similar to those of cotton articles and more particularly having improved properties which enable the cellulose material to be used for a wider range of purpose. For example, McCorsley, U.S. Pat. No. 4,246,221 shows a process where cellulose is dissolved in a solvent containing a tertiary amine N-oxide and water which is a solvent for the cellulose. The solution is then shaped by extrusion or spinning first into air or other nonprecipitating medium to form a film or filament. Then the film or filament is stretched in the medium to impart improved physical properties prior to precipitation of the cellulose. Subsequently, it is treated with a nonsolvent which precipitates the cellulose. The shaped solution emerging from the shaping dye is pulled from its point of emergence from the dye at a speed faster than its emerging speed so that it is stretched and reduced in thickness in the space before the cellulose is precipitated in the nonsolvent. In this process, the technique of stretching is defined by the spin-stretch ratio which is the linear speed of the precipitated article divided by the linear speed of the solution emerging from the dye. Orientation of the cellulose molecules is achieved by the stretching in the solution and as a result develops the properties of the shaped article prior to precipitation of the cellulose. After precipitation of the cellulose, the properties are set. This eliminates the need for stretching after precipitation and avoids the need for drawing apparatus which conventionally was used in the past. Details of the process are disclosed in McCorsley, U.S. Pat. No. 4,246,221 which is relied on and incorporated herein by reference.

More recently, further improvements have been made in methods for producing this modified type of viscose cellulose, now called lyocell, including where the cellulose is suspended in an aqueous solution of the tertiary amine oxide containing water and is then heated to temperatures between 90 to 120° C. with stirring. See Zikeli et al., U.S. Pat. No. 5,094,690. In that patent, the heat treatment is performed over a substantially shorter period of time in order to minimize the thermal load on the cellulose and the tertiary amine oxide. The system shown in Zikeli et al. utilizes a heating surface that spreads the solution of the cellulose and the tertiary amine oxide in layers of coats until the homogeneous solution of the cellulose has formed. Rapid heating is then feasible without degradation of the cellulosic material according to the patentees. Further details of the system for producing the modified cellulose are shown in Zikeli et al., U.S. Pat. No. 5,094,690 which is relied on and incorporated herein by reference.

SUMMARY OF THE INVENTION

It is an object of the present invention to produce a nonwoven blended needlepunch fabric having superior properties and which avoids and overcomes drawbacks of prior fabrics comprised of various fibers and fiber blends.

In achieving the above and other objects, one feature of the invention resides in a non-woven needlepunch blend made from 60% to 90% lyocell fiber having a denier, prior to fibrillation, of 0.75 to 6, preferably 1.5 to 3, a length from 1 inch to 6 inches and from 10% to 40% polyester fiber having a denier of 0.75 to 15, preferably 3 to 6 and a fiber length of 1 inch to 6 inches in length. Up to 30% of the fabric can include other textile fibers. The fibers are blended and subjected to a needle loom. The weight of the needlepunch nonwoven fabric produced can be controlled to be in the range of, for example, 1.75 ounces per square yard to 10 ounces per square yard. However, the weight range can be broader, as for example, from 1.5 ounces per square yard up to 40 ounces per square yard, or higher, depending on the capabilities of the needlepunch line. The needlepunch fabrics of the present invention are characterized by a loftiness, softness and a low lint level, improved wet strength including better wet collapse properties, improved wicking properties and improved fluid retention properties.

BRIEF DESCRIPTION OF THE DRAWING

The invention will be more readily understood from a reading of the following specification and by reference to the accompanying drawing forming a part thereof, wherein an example of the invention is shown and wherein.

DETAILED DESCRIPTION OF INVENTION

Figure 1:
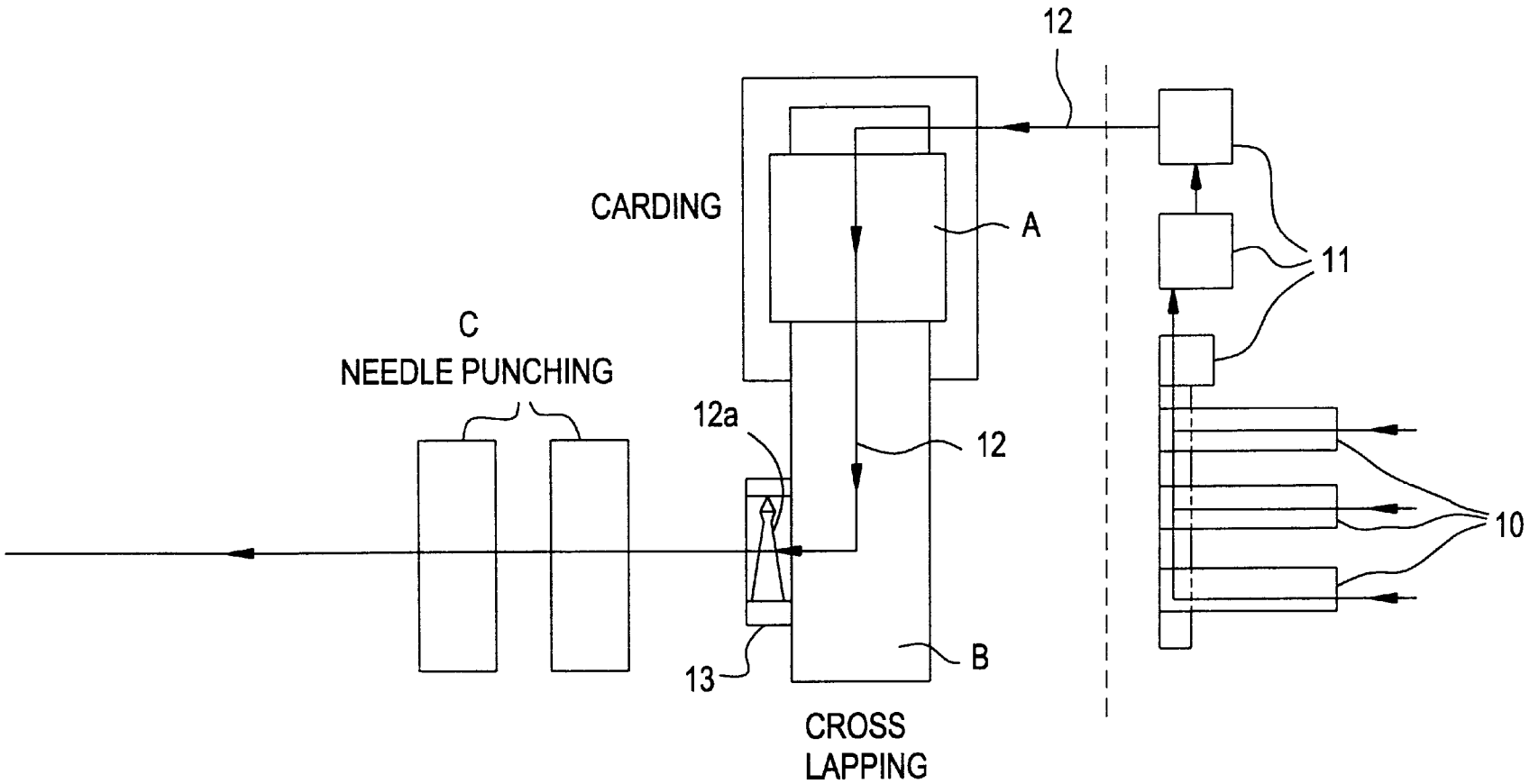
FIG. 1 is a block diagram illustrating steps in web formation and entanglement including blending, carding, cross lapping and needlepunching in accordance with the invention.

A representative construction designed to carry out the invention will be hereinafter described, together with other features thereof.

The method of making the nonwoven fabric in accordance with the invention includes subjecting a web of fibers which have been opened and blended to suitable additional web forming apparatus, preferably including one or more carding machines, illustrated at A in FIG. 1. Fibers of the carded web are then oriented predominately in a cross direction as by the action of a cross lapper B. The cross-lapped web is subsequently needlepunched, preferably by suitable needle punching apparatus C.

The block diagram of FIG. 1 generally illustrates schematically the method of making the nonwoven fabric. The primary fibers; namely, polyester and lyocell in the form of bales as they are received from the manufacturer are subjected to a standard opener apparatus at 10. Each type of fibrous bale is fed to its own opener apparatus at 10. The fibrous materials having been subjected to the standard type opener apparatus in the industry are then blended at blending stage 11, utilizing standard apparatus known in the trade. The resulting fibrous mass 12 is then conveyed to and subjected to the action of one or more standard carding machines A from whence the resulting fibrous web passes to a standard cross lapper B.

Cross lappers manufactured by a number of manufacturers have been found to produce a satisfactory cross-lapped web. The web 12 laid in cross laps 12*a* is illustrated in FIG. 1 as exiting on the outlet apron 13 of the cross lapper.

The web 12 is subsequently carried to the needle punch unit C where the fibers are interlocked together forming the fabric by a needlepunching process.

Needle punching is a form of mechanical bonding of fibers which have normally been produced by a card or other equipment. The process converts the web of loose fibers into a coherent nonwoven fabric using a needle loom. Needle looms of various type are well known in the art and function by bonding a nonwoven web by mechanically orienting fibers through the web. The process is called needling, or needlepunching. Barbed needles, set into a board, punch fiber into the batt and withdraw, leaving the fibers entangled. The needles are spaced in a nonaligned arrangement. By varying the strokes per minute, the number of needles per loom, the advance rate of the batt, the degree of penetration of the needles, and the weight of the batt, a wide range of fabric densities can be made. The needle loom can be operated to produce patterned or unpatterned products.

FIG. 1 illustrates major apparatus used in the process of the invention, however, it will be understood that various auxiliary equipment can be present at various stages as will be apparent to those skilled in the art to produce these expected functions such as web drafting, sliting, wind up, doffing etc.

The lyocell polymeric material which is used herein to form a component of the nonwoven needlepunch fabrics is supplied by the manufacturer in the form of compressed bales. The material is hydrophilic and swells in water which makes it suitable for a range of applications in making products of high absorbency on exposure to water the cross sectional area of the fiber increases by 50% which is over twice the swelling obtained by using ordinary cotton. The lyocell has a higher water imbibition than cotton but lower than that of viscose. Products made from viscose generally lose their bulk when wetted due to the low wet modulus of viscose as explained above. The result is reduction in inter fiber pore volume with a lower total absorbent capacity. In contrast, lyocell has a higher wet modulus which makes it resistant to wet collapse and leads to improved absorbent capacity.

It is known that the rate of fluid absorption depends on the pore size. Smaller dry pores increase the capillary force which drives fluid uptake while larger wetted pores reduce the viscous drag that slows down fluid transport. The rates of transplaner absorption and wicking in a fabric are therefore highly dependent on fabric construction.

However, in conventional viscose nonwoven fabrics, wet collapse can drastically reduce the size of pores in the wet structure thereby increasing the drag forces which inhibit flow. In comparison, lyocell has great resilience which helps maintain pore integrity and favors faster wicking rates.

It has been found that fibrillation of lyocell during wet processing can increases the rates of absorbency since the fibrils are able to increase capillary forces and thus help bridge large interfiber voids.

Lyocell is known for its higher tensile and bursting strength compared to ordinary viscose products which makes lyocell containing products stronger and more stable than conventional viscose products. Lyocell fabrics are over twice as strong as viscose when dry and three times as strong when wet. As a result, lyocell can be used to make lighter products and thereby reduce the level of nonabsorbent binding materials.

Lyocell fibers as furnished by the manufacturer have a white appearance, a specific gravity of 1.5 and are insoluble in water. The name "lyocell" has been approved by the Federal Trade Commission as a generic name for this new type of viscose.

Because it is environmentally friendly and produced from the wood pulp of trees growing specifically for this purpose, lyocell is an attractive product. It can be made using a solvent spinning technique such as disclosed in Zekeli et l., U.S. Pat. No. 5,094,690. The dissolving agent can be recycled easily thereby reducing environmental effluent. One source of lyocell is sold by Courtaulds Fibers of London, England.

The Courtaulds brand lyocell fiber suitable for purposes of the invention is a 1.5 denier×1½ inch (38 mm) bright bleached crimped style material with the following characteristics:

| Property | Specification |
|---|---|
| Tenacity | 4.5 gpd |
| Elongation | 13–17% |
| Denier | 1.36–1.65 |
| Finish | 0.18–0.38 |
| Color | ≧40 on-line |
| Crimp | ≧21/10 cm (ave) |

The lyocell fiber used according to the invention has a denier, prior to fibrillation, in the range of 0.75 to 6, preferably 1.5 to 3, and a length of 1 inch to 6 inches, preferably 1.5 to 3 inches. The non-woven fabric produced hereby contains 60% to 90% by weight lyocell, preferably 70%.

The terms "denier" as used herein is defined as a weight-per-unit-length measure of any linear material. Officially, it is the number of unit weights of 0.05 grams per 450-meter length. This is numerically equal to the weight in grams of 9,000 meters of the material. Denier is a direct numbering system in which the lower numbers represent the finer sizes and the higher numbers the coarser sizes. In the U.S., the denier system is used for numbering filament yarns (except glass), manufactured fiber staple (but not spin yarns), and tow.

The second component of applicants' novel needlepunch fabric is a polyester fiber. Polyester fibers are manufactured fiber in which the fiber forming substance is any long chain synthetic polymer composed of at least 85% by weight of an ester of a dihydric alcohol and terephthalic acid. The polymer is typically produced by the reaction of ethylene glycol with terephthalic acid or its derivatives. Fiber forms produced are filament, staple and tow. The process of production is well known and resembles that of nylon. Polymerization is accomplished at a high temperature using a vacuum. The glycol and the terephthalic acid ester reaction forms a polymer chain releasing methanol. As with nylon and many other synthetic materials, the filaments are spun in a melt spinning process, then stretched several times the original length which orients the long chain molecules and gives the fiber its strength.

The polyester fibers have a high strength and are resistant to shrinking and stretching. Fabrics made therefrom are quickly drying and tend to have wrinkle resistance and increased retention in the wet and dry state. It is one of the first fibers to be developed in fabrics with permanent press features. The polyester that is used in the present invention is the typical commercially available polyester fiber of which there are many types available in the art.

For example, a suitable polyester for purposes of the present invention is the product sold under the mark DELCRON®. It is a homopolymer of the ester of ethylene glycol and terephthalic acid and has a whitish appearance; the fiber being rounded in cross section. The following is a table of its properties:

| | |
|---|---|
| Tenacity at break | 3.00–4.40 gpd |
| Elongation at break | 36.10–51.90% |
| Denier per filament | 4.60–4.90 |
| Crimps per inch | 6.40–9.00 N° per inch |
| Crimp take-up | 28.0–34.0% |
| Finish on fiber | 0.160–.280% |
| "L" color | 86.20–88.60 N° |
| "b" color | −9.20–6.8 N° |
| Shrinkage | 3.20–7.80% |

The polyester fiber used in accordance with the present invention has a denier value of 0.75 to 15, preferably 3 to 6, and a length of 1 to 6 inches, preferably 1.5 to 3 inches. The fabric produced according to the present invention contains 10% to 40%, preferably 30% by weight of polyester. The nonwoven fabric as described herein can be bonded to another and dissimilar fabric.

In preparing the nonwoven fabrics of the present invention, the lyocell fibers and the polyester fibers in the lengths given above are blended together using suitable apparatus, such as shown in the drawing.

Although lyocell and polyester are the primary components, the needlepunch fabric of the invention can contain up to 30%, more usually no more than 10% by weight of other textile fibers such as cotton, rayon as well as synthetics such as acrylics and polypropylene.

In producing the webs prior to needlepunching, it is preferred that the web is attenuated, such as by web drafting, thereby tending to orient the fiber in the direction of movement of the web; i.e. in the machine direction. Depending on the operating parameters of the needle loom, patterns can be formed in the fabrics according to the invention and hence patterned as well as unpatterned fabrics are contemplated within the scope of the present invention.

Any suitable type of apparatus can be used for preparing the products of the invention and there are numerous types that are known in the art.

Further variations and modifications of the invention will be apparent to those skilled in the art from the foregoing and are intended to be encompassed by the claims appended hereto.

We claim:

1. A non-woven needlepunch fabric consisting essentially of 60% to 90% by weight lyocell fiber having a length of one inch to six inches, 10% to 40% by weight polyester fiber having a length of one inch to six inches and 0% to 30% of other textile fibers, wherein said lyocell fiber has a denier in the range of 0.75 to 6 prior to fibrillation, said fabric having been formed by subjecting said fiber to carding, cross-lapping and needle punching to produce a fabric with interlocked fibers.

2. The fabric according to claim 1 wherein said polyester fiber has a denier of 0.75 to 15.

3. The fabric according to claim 1 which has a weight of 1.75 to 10 ounces per square yard.

4. A non-woven fabric according to claim 1 which is bonded to another and dissimilar fabric.

5. The fabric according to claim 1 consisting of 70% lyocell and 30% polyester by weight which is patterned or unpatterned.

* * * * *